United States Patent [19]

Johansson

[11] 4,359,087

[45] Nov. 16, 1982

[54] PLATE HEAT EXCHANGER

[75] Inventor: Börje Johansson, Helsingborg, Sweden

[73] Assignee: Alfa-Laval AB, Tumba, Sweden

[21] Appl. No.: 211,909

[22] Filed: Dec. 1, 1980

[30] Foreign Application Priority Data

Dec. 3, 1979 [DE] Fed. Rep. of Germany ..... 2948586

[51] Int. Cl.[3] ..... F28F 3/10

[52] U.S. Cl. ..... 165/167

[58] Field of Search ..... 165/166, 167

[56] References Cited

U.S. PATENT DOCUMENTS 2,361,691 10/1944 Jendrassik ..... 165/166
3,308,879 3/1967 Maddocks ..... 165/167
4,293,033 10/1981 Nasser ..... 165/166

FOREIGN PATENT DOCUMENTS 2910005 9/1980 Fed. Rep. of Germany ..... 165/166
2064750 6/1981 United Kingdom ..... 165/167

*Primary Examiner*—Sheldon J. Richter
*Attorney, Agent, or Firm*—Cyrus S. Hapgood

[57] ABSTRACT

In an assembly of spaced heat exchange plates, each second interspace is sealed from the surrounding atmosphere by gasket means extending along the periphery of the adjacent plates forming such interspace, the other interspaces being sealed from the surrounding atmosphere by permanent joints between the adjacent plates forming said other interspaces. The plates have pressed corrugations in their heat exchanging surfaces and also have pressed grooves extending around said surfaces for receiving the gasket means. The permanent joints are formed along abutting bottoms of the pressed grooves of the respective adjacent plates. The seals formed by said joints and the seals formed by the gasket means are disposed in aligned relation across the plate heat exchanger.

5 Claims, 5 Drawing Figures

PLATE HEAT EXCHANGER

THE DISCLOSURE

The present invention relates to a plate heat exchanger in which every second plate interspace is sealed off from the surrounding atmosphere along the periphery of the adjacent plates by gasket means (e.g., rubber gaskets) and the rest of the plate interspaces are sealed off by permanent joints between the adjacent plates, said plates being provided with pressed corrugations in their heat exchanging surfaces and with pressed grooves around these surfaces for said gasket means, the plates further being provided with inlet and outlet ports for two heat exchanging media.

A previously known plate heat exchanger of this kind is disclosed in the Swedish patent specification No. 402,642 and comprises cassettes (pairs) of plates which are intended to be clamped together with intermediate gaskets in a conventional plate heat exchanger frame. Each cassette plate, which has a quadratic or circular form, is provided at its periphery with a bent edge flange on one side of the plate. It is also provided with openings, half the number of which have collars on the same side of the plate as the edge flange. The two plates of each cassette are turned with the edge flanges and the collars against each other and closely joined, for example by welding, along the same. In each cassette plate there is a pressed groove for a gasket just inside the edge flange, the gasket being intended to form a seal between the cassette plate and one of the plates of an adjacent cassette.

The plate heat exchanger disclosed in said SE. No. 402,642 is difficult and expensive to manufacture. This is mainly because of the extreme requirement for accuracy in getting the bent edges of the respective cassette plates in exact position for proper welding, which calls for much more than a simple pressing operation.

Also, the plate heat exchanger disclosed in SE No. 402,642 is disadvantageous in operation, and this is because there is admitted within each cassette a flow of heat exchanging medium in the area between the peripheral flanges of the cassette plates and the underneath sides of the grooves pressed in the cassette plates (i.e., the grooves for the gaskets arranged between adjacent cassettes). Admittance of flow in this area means, if the medium in question is extremely hot, that the gaskets arranged between the cassettes are subjected to a very high temperature (through heat conduction via the cassette plates) by all of the contact surfaces between the gaskets and the cassette plates. This is clearly detrimental to conventional gaskets as used in this connection.

The principal object of the present invention is to provide an improved plate heat exchanger of the kind described above, at least as regards the previously mentioned disadvantages of the known plate heat exchanger.

This object is fulfilled by the invention in that the previously mentioned permanent joints are formed along abutting underneath sides of said pressed grooves of the respective adjacent plates, in a manner such that the seals formed by the permanent joints and the seals formed by the gasket means are arranged substantially aligned across the plate heat exchanger.

According to the invention, the permanent joinings of the plates in question are thus performed along the bottoms of the respective gasket grooves. Preferably seam welding is used, but other methods could be used as well, such as gluing, rubber curing or plastic bonding. Soldering is, of course, also possible.

A plate heat exchanger according to the invention is less expensive to manufacture. Further, the heat exchanging surface of one side of each plate will have the same size as that of the other side of the plate.

According to a preferred embodiment of the invention, the heat exchanger is constructed from plates having gasket grooves which are mainly similar as regards their positioning and shape. Every second plate is turned 180° around an axis in the plane of the plate so that the bottom of the gasket groove on one of the plates abuts the bottom of the gasket groove on the other plate. The two plates are joined together in the abutment area at the bottom of the gasket groove. The most resistant joining of the plates takes place by welding the plates together either with a seam weld or melt weld. The plates may alternatively be joined together by soldering, gluing, rubber curing or plastic bonding.

Ordinary plates in plate heat exchangers have a gasket groove which is formed so that it has a relatively wide plane bottom (~10 mm), while the sides of the gasket groove form an angle which is more than 90° with the bottom. In the new plate heat exchanger, the plates have a gasket groove where the plane part in the middle is made thinner (~4 mm) while the rest of the bottom forms an obtuse angle both with the plane part and the sides of the groove. The welding of the plates takes place on the plane part around the center line of the gasket groove.

The pressing tools that are used for pressing the heat exchanger plates are relatively expensive to manufacture and it is therefore of an economical advantage to construct the heat exchanger of plates which are identically alike. The proposed heat exchanger may be constructed from identically alike plates by turning every second plate 180° around its transverse central line. In that way the bottoms of the gasket grooves are made to abut each other, and ridges and valleys in the corrugation pattern are made to cross each other, whereby supporting points are obtained between the two heat transferring areas of the plates.

The heat exchanger of the invention is described further with reference to the attached drawing which shows a preferred embodiment of the invention. In the drawing, FIG. 1 shows a pair of plates permanently joined together as seen from above;

Figure 1:
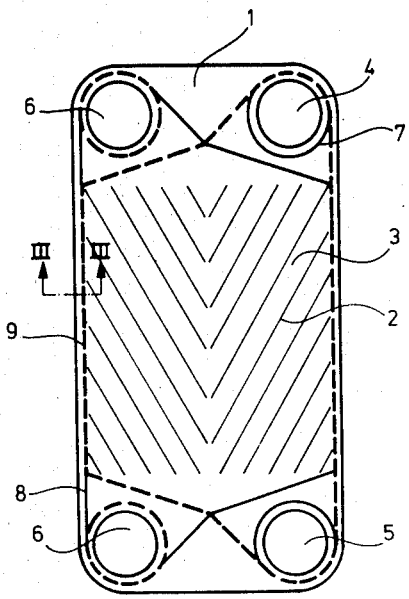

In FIG. 1 there is shown the upper rectangular plate 1 of the pair of plates, which plate is provided with a corrugation pattern 2 over the heat transfer area 3. The plate is also provided with inlet and outlet holes 4, 5 for one of the heat exchanging fluids which flows under the plate 1 between the permanently joined plates. The plate 1 also has through-flow holes 6. Around the holes and the heat transfer area there are gasket grooves 7, 8. The plate 1 and the other plate in the pair are permanently joined together with a welding joint along the bottoms of the gasket grooves. In FIG. 1 the welding joint is shown with a line of short dashes. As is seen in the drawing, the welding joint is shown with a line of short dashes. As is seen in the drawing, the welding joint surrounds the inlet and outlet holes 4, 5 and the heat transfer area 3. The through-flow holes 6 are also surrounded by welding joints.

Figure 2:
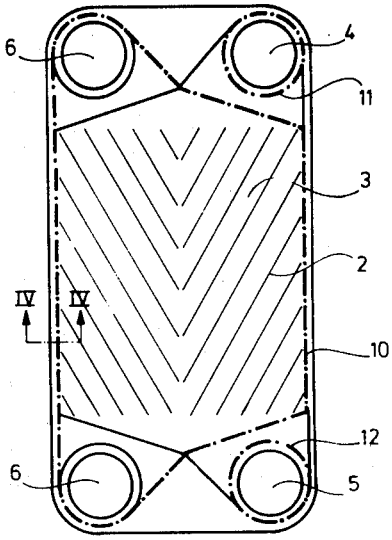
FIG. 2 shows the same pair of plates provided with a gasket.

In FIG. 2 there is shown the same pair of plates as in FIG. 1, but now the gaskets which are to form a sealing against the next pair of plates are located in the gasket grooves. The gaskets are shown by lines of dots and dashes. The gasket 10 surrounds the through-flow holes 6 and the heat transfer area. The through-flow holes 6 now act as inlet and outlet holes for the second heat exchanging fluid which is to flow over the upper side of the plate 1. The "inlet" 4 and the "outlet" 5 holes are both surrounded by gaskets 11 and 12.

Figure 3:
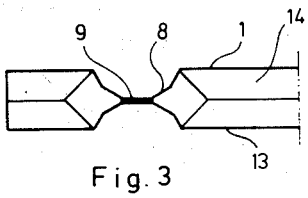
FIG. 3 is an enlarged sectional view on line III—III in FIG. 1.

In FIG. 3 there is shown an enlargement of a section III—III through the pair of plates in FIG. 1. As shown in FIG. 3, the bottom of the gasket groove 8 of the plate 1 abuts the bottom of the gasket groove of the underlying plate 13. The welding joint 9 which permanently joins the plates 1 and 13 restricts the flow space 14.

Figure 4:
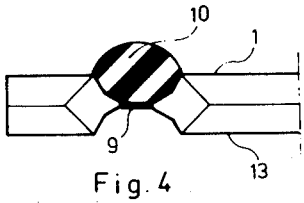
FIG. 4 is an enlarged sectional view on line IV—IV in FIG. 2.

In FIG. 4, which is an enlargement of section IV—IV in FIG. 2, there is shown how the gasket 10 is arranged in the gasket groove 8.

Figure 5:
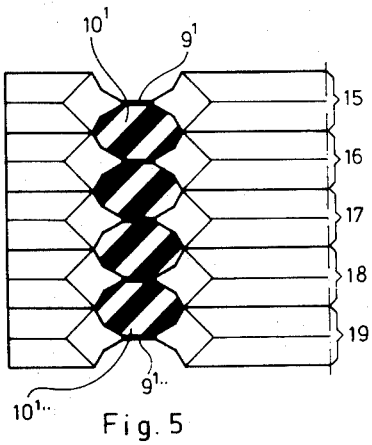
FIG. 5 is a sectional view through five plate pairs.

In FIG. 5 there is shown a section through five plate pairs which constitute a pair of a plate heat exchanger. The plate pairs 15, 16, 17, 18 and 19 are all joined by means of welding joints 9'. The flow spaces which are created between the plate pairs 15 and 16, 16 and 17, are tightened by means of gaskets 10'.

I claim:

1. In the plate heat exchanger, the combination of an assembly of heat exchanger plates disposed in substantially parallel relation to form a series of interspaces, one said interspace being provided between each pair of adjacent plates, gasket means sealing off each second plate interspace from the surrounding atmosphere along the periphery of the adjacent plates forming said second interspace, and permanent joints sealing off the other interspaces from the surrounding atmosphere and located between the adjacent plates forming said other interspaces, each plate having a heat exchanging surface and pressed corrugations in said surface, each plate also having pressed grooves around said surface for receiving said gasket means, each plate being provided with inlet and outlet ports for two heat exchanging media, said permanent joints being formed along abutting bottoms of said pressed grooves of the respective adjacent plates, the seals formed by the permanent joints and the seals formed by the gasket means being disposed in substantially aligned relation across the plate heat exchanger.

2. The combination of claim 1, in which said permanent joints are formed by seam welding along said abutting bottoms of the pressed grooves.

3. The combination of claim 1, in which said permanent joints are formed by gluing.

4. The combination of claim 1, in which each said plate has four of said inlet and outlet ports, one port being located in each of four corner portions of the plate, said pressed grooves of each plate surrounding an area of the plate including said heat exchanging surface thereof and two of said ports serving as inlet and outlet ports, said pressed grooves also separately surrounding each of the other two ports of the plate, said permanent joints being formed along abutting bottoms of all said pressed grooves of the respective adjacent plates.

5. In a plate heat exchanger, the combination of an assembly of heat exchange plates disposed in substantially parallel relation to form a series of interspaces, one said interspace being provided between each pair of adjacent plates, gasket means sealing off each second plate interspace from the surrounding atmosphere along the periphery of the adjacent plates forming said second interspace, and permanent joints sealing off the other interspaces from the surrounding atmosphere and located between the adjacent plates forming said other interspaces, each plate having a heat exchanging surface and pressed corrugations in said surface, the plates also having pressed grooves around said surfaces for receiving said gasket means, the plates being provided with inlet and outlet ports for two heat exchanging media, said permanent joints being formed along abutting bottoms, of said pressed grooves of the respective adjacent plates, the seals formed by the permanent joints and the seals formed by the gasket means being disposed in substantially aligned relation across the plate heat exchanger, the bottom of the gasket groove of each plate having a narrow flat central portion along which the permanent joint is formed, the groove also having two lateral portions forming an obtuse angle both with said central part and with the respective side walls of the groove.

* * * * *